United States Patent [19]

Lawrence et al.

[11] Patent Number: 4,956,583

[45] Date of Patent: Sep. 11, 1990

[54] CONTROL SYSTEM FOR ELECTRICAL LIGHTING

[75] Inventors: John A. Lawrence; David A. Finch, both of Nutley, England

[73] Assignee: Econolight Limited, London, England

[21] Appl. No.: 207,158

[22] PCT Filed: Oct. 26, 1987

[86] PCT No.: PCT/GB87/00756

§ 371 Date: Jul. 11, 1988

§ 102(e) Date: Jul. 11, 1988

[87] PCT Pub. No.: WO88/03353

PCT Pub. Date: May 5, 1988

[30] Foreign Application Priority Data

Oct. 27, 1986 [GB] United Kingdom ..... 8625690
Oct. 27, 1986 [GB] United Kingdom ..... 8625691

[51] Int. Cl.[5] ..... H05B 37/00

[52] U.S. Cl. ..... 315/220; 315/226; 315/277; 315/287; 315/291; 315/DIG. 5

[58] Field of Search ..... 315/219, 220, 225, 226, 315/277, 282, 287, 291, 307, DIG. 2, DIG. 5

[56] References Cited

U.S. PATENT DOCUMENTS 3,479,558 11/1969 Peek ..... 315/98
3,890,539 6/1975 Remery ..... 315/273
4,147,961 4/1979 Elms ..... 315/291
4,147,962 4/1979 Engel ..... 315/291
4,339,690 7/1982 Regan et al. ..... 315/97
4,484,109 11/1984 Buser ..... 315/290
4,511,195 4/1985 Barter ..... 315/308

FOREIGN PATENT DOCUMENTS 0150237 8/1985 European Pat. Off. .
1479474 5/1967 France .

*Primary Examiner*—Robert J. Pascal
*Attorney, Agent, or Firm*—Oliff & Berridge

[57] ABSTRACT

A control system for lighting a bank of fluorescent lamps, includes input terminals (10, 11) for a mains voltage (e.g. 240 v) and output terminals (20, 21) to which the bank of lamps is connected. A transformer (T1) provides a reduced voltage (216 v) as compared to the mains supply voltage. The transformer (T2) provides a supplementary voltage (24 v). Upon start up of the circuit, a control circuit (CC) operates contact (A1) to energize the transformer (T2) so that terminals (20, 21) receive both the reduced voltage from (T1) and the supplementary voltage from (T2) (i.e. 240 v) which is sufficient to ignite the fluorescent lamps. The control circuit (CC), after a predetermined delay (e.g., 15 seconds), switches contact (A1) to disconnect the supplementary voltage from (T2). The lamps then continue to operate on the reduced voltage (216 v) thereby reducing the power consumed by the lamps.

13 Claims, 5 Drawing Sheets

TIME

0V
V
0V
V
0V

CONTROL SYSTEM FOR ELECTRICAL LIGHTING

FIELD OF THE INVENTION

This invention relates to a control system for electrical lighting, having particular but not exclusive application to fluorescent lighting configurations in large office blocks for example.

BACKGROUND TO THE INVENTION

With the cost of electricity being an important factor in operating lighting systems, especially on a large scale, there is a need to seek ways of reducing power consumption, to provide improved economy. This is especially true of the fluorescent lighting configurations found in large office blocks and other industrial premises It has been found possible to reduce the voltage supply to lights without producing a noticeable drop in light output and it has been proposed to achieve this by means of a transformer in order to give a power reduction to the system. With fluorescent lamps, in order to ensure reliable ignition upon switching on, it is however necessary to provide the full rated mains voltage at the time of switch on. To achieve this, it would in theory be possible to provide a transformed output during normal running of the lamps, but at start up, the transformer would be switched out and full mains voltage directly applied to the lamps A major problem with such a configuration, especially with banks of lamps, is the power surge that is generated A 10 kva transformer for a bank of up to 200 lamps when switched, could generate a surge of the order of 400 amps, which among other things would rapidly degrade the switching contacts employed and be unreliable in use.

SUMMARY OF THE INVENTION

The present invention is concerned with power reduction without the drawbacks mentioned.

According to the invention there is provided a control system for lighting comprising, means for providing a reduced voltage below normal mains voltage for the lighting to provide a reduced power output during operation thereof, means for providing a supplementary voltage when initially operating the lighting to increment the reduced voltage to a value approximating to normal mains voltage and means for thereafter removing the supplementary voltage.

The means for providing a reduced voltage may comprise means providing a first transformer winding and the means for providing the supplementary voltage may comprise means providing a second transformer winding Conveniently, the reduced voltage is provided by a first transformer and the supplementary voltage is provided by a second transformer, Alternatively, said voltage providing means may both be provided in the same transformer.

The means for removing the supplementary voltage preferably includes timer means for removing the voltage after a predetermined period. The timer means may be triggered by current sensing means which senses current demand in the lighting system associated with switching on of the lamps.

BRIEF DESCRIPTION OF THE DRAWINGS

In order that the invention may be more fully understood, embodiments thereof will now be described by way of example with reference to the accompanying drawings wherein.

DETAILED DESCRIPTION

The first embodiment of the invention described with reference to FIG. 1, comprises a control system for supplying electrical power to fluorescent lamps, the supply being switched between a level approximating the mains voltage at turn on of the lamps, to a reduced voltage level which does not produce a noticeable drop in illumination but which provides a substantial improvement in economy. The system is described for use with a UK mains supply at 240 volts but it will be readily appreciated that the system can be adapted for use with other mains voltage supplies e. g. 110 volts Mains voltage at full rating, i.e. 240 volts is provided at terminals 10, 11 and an output for supply to a bank of fluorescent lamps (not shown) is provided at terminals 20, 21. A first transformer T1 in the form of an autotransformer has winding tappings W1, W2 connected across the mains voltage supply terminals 10, 11. The transformer T1 also has an output tapping W3 which provides a voltage less than mains voltage (e.g. 216 volts) which is supplied to the output terminals 20, 21.

A second, step-down transformer T2 has its primary winding tappings W4, W5 connectible to the mains supply terminals 10, 11 through a changeover switch contact A1. The secondary winding tappings W6, W7 are connected in series with output terminals 20 and the tapping W3. A control circuit CC, shown schematically in FIG. 1, controls operation of changeover contact A1. In a first position of Al the transformer T2 is connected to provide a voltage in its secondary which increments the reduced voltage produced by transformer T1, so as to provide an output voltage at terminals 20, 21 which closely approximates full mains voltage When the control circuit CC operates changeover switch A1 away from the position shown in FIG. 1, the terminals W4, W5 of the primary of T2 are effectively short circuited such that T2 no longer produces the supplementary voltage and also does not impede current flow from T1 to the output terminals 20, 21.

As will be described in more detail hereinafter, the control circuit CC is so arranged that upon start-up of the lamps, switch A1 is in the position shown in FIG. 1 so that a voltage approximating to mains voltage is produced at terminals 20, 21, to enable switch on of the lamps A short period thereafter, e.g. fifteen seconds, the control circuit CC switches A1 to the other position so as to disable operation of transformer T2 and thereby reduce the voltage supplied to the lamps by approximately 10% of normal mains voltage.

A more detailed example of the arrangement of FIG. 1 will now be described with reference to FIG. 2 in which the function of the control circuit CC is performed by a timer.

Figure 1:
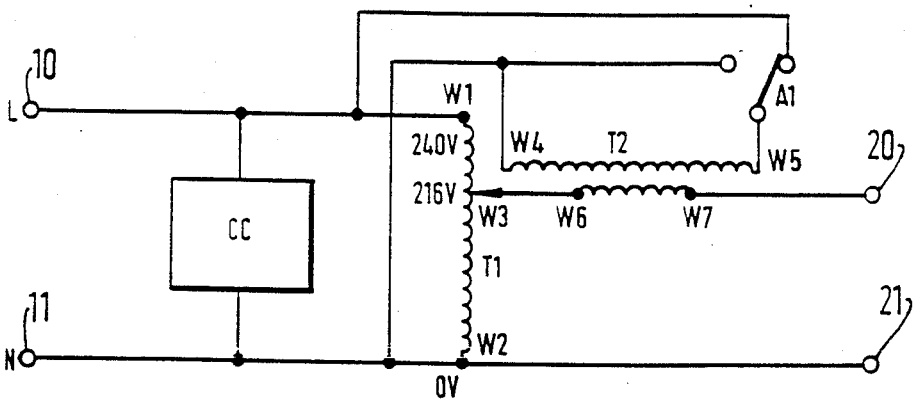
FIG. 1 is a block diagram of an embodiment of the invention.

Like parts to those in FIG. 1 have been given the same reference numbers Thus the mains supply voltage is supplied through terminals 10, 11 to the transformer T1 via normally closed contacts CB1 and CB2 of a circuit breaker CB. The tapped output W3 of T1 is fed through the secondary winding of T2 and thence through normally closed contact CB3 of circuit breaker CB. The contact A1 which controls operation of transformer T2, is operated, by contactor coil A, which has a further contact A2 that switches power to a neon L1 to signify when "mains-boost" is being provided by transformer T2.

Figure 2:
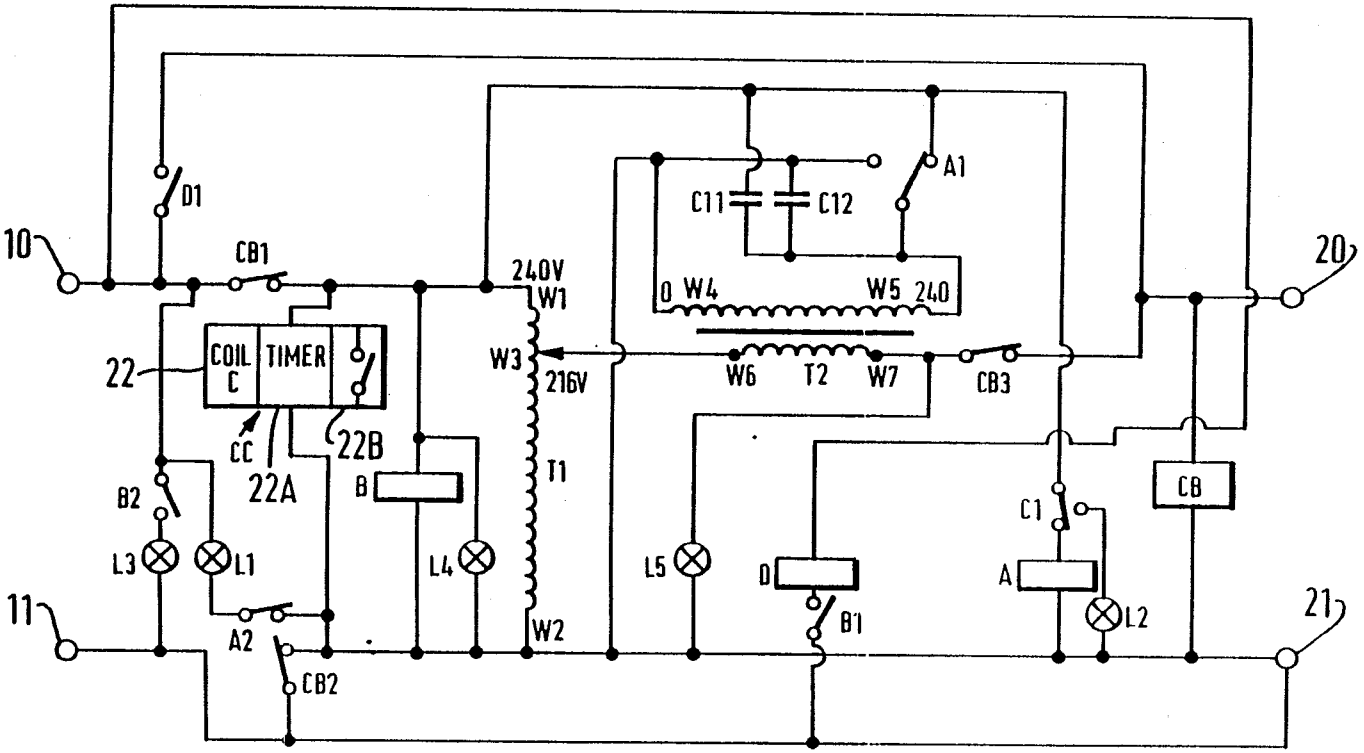
FIG. 2 is a circuit diagram of a first example of a control system of the invention according to the embodiment of FIG. 1.

The primary winding of transformer T2 has capacitors C11 and C12 connected to the live and neutral rails respectively to suppress switching transients produced by operation of contact A1 Operation of the contactor A is controlled by a relay 22 having a control coil C, a timer module **22*a* and an actuator switch 22*b*** of known configuration The coil C controls operation of change-over contact C1, which in the position shown in FIG. 2 supplies current to the contactor A and in its other position energizes neon L2 that indicates that the system is running in "economy mode".

A further relay B is provided which operates contact B1 that switches power to a contactor having a coil D which operates contact D1. Also, the relay B operates contact B2 in order to switch voltage to neon L3.

The control system shown operates as follows. When it is desired to operate the lamps, power is initially connected to the terminals 10, 11 by switching circuits (not shown).

The user will then actuate switch **22*b* which causes the relay to be released for a period determined by the timer module 22*b* so that contact C1 moves into the position shown in FIG. 2. Consequently, the "economy mode" neon L2 is switched off Contactor coil A is energized and its contacts A1 and A2 are moved into the positions shown in the Figure. The closure of A2 causes "mains boost" neon L1 to be illuminated. The switching of A1 causes the primary of transformer T2 to be connected across the mains rails. This allows the supplementary voltage from transformer T2 together with the output from transformer T1 to be applied to the fluorescent lamps connected to terminals 20, 21. The output from transformer T1 is typically 216 volts and transformer T2 provides a supplementary voltage of approximately 24 volts to give a full 240 volts mains requirement. The timer module 22*a*** is set to give sufficient time for the lamps to ignite using their associated starters, before timing out (e.g. 15 seconds).

Thereafter, the, relay 22 is actuated to cause contact C1 to move to the alternative position to that shown in FIG. 2, so that contactor coil A is de-energized, causing contact A1 to move to the alternative position so that the primary winding of T2 is disconnected from terminal 10 and effectively short circuited to prevent any unwanted power losses Contact A2 switches off neon L1. Capacitors C11, C12 suppress any unwanted spikes resulting from switching of A1. With contact A1 in this position, no supplementary voltage is produced by the secondary of T2 and the output at terminals 20 and 21 is provided solely by the transformer T1 i.e. 216 volts.

As the output is taken through the secondary of transformer T2, the transformer is wound so as to provide a low impedance path to minimize losses. The system will provide power at this reduced voltage continuously thereafter to give the desired saving in power consumption.

Should the system become overloaded, the circuit breaker CB having a rating of say 50 amps will actuate causing contacts CB1–CB3 to open This isolates transformer T1 from the input and output terminals 10, 11 and 20, 21 and will effectively isolate transformer T2. Opening of CB1 and CB2 will also de-energize relay B so that contacts B1 and B2 will close Neon L3 will light due to the closure of B2 so as to signify the overload condition. The closure of contact B1 causes contactor D to energize which closes contact D1 thereby providing a direct connection between terminals 10 and 20, bypassing the control system to prevent damage thereto and to permit the system to continue to operate. Should the overload be due to a fault condition, fuses (not shown) associated with the lamps would blow in the normal way.

Neons L4, L5 indicate when the primary and secondary sides of the transformer T1 are energized; both neons will be actuated in normal operation of the circuit.

It will appreciated that other values for the reduced and supplementary voltages could be selected. However with the values used in the example described with reference to FIG. 2, it has been found that with a wattmeter fitted, tests have indicated a saving in the region of 20% of the power consumed for a negligible loss in light output.

By switching only the supplementary power in the manner described, it has been possible to reduce dramatically the power rating of the contact (A1) needed. For example a 20 kva system can be handled with a contact rating of only 10 amps without the deterioration associated with switching large loads.

Figure 3:
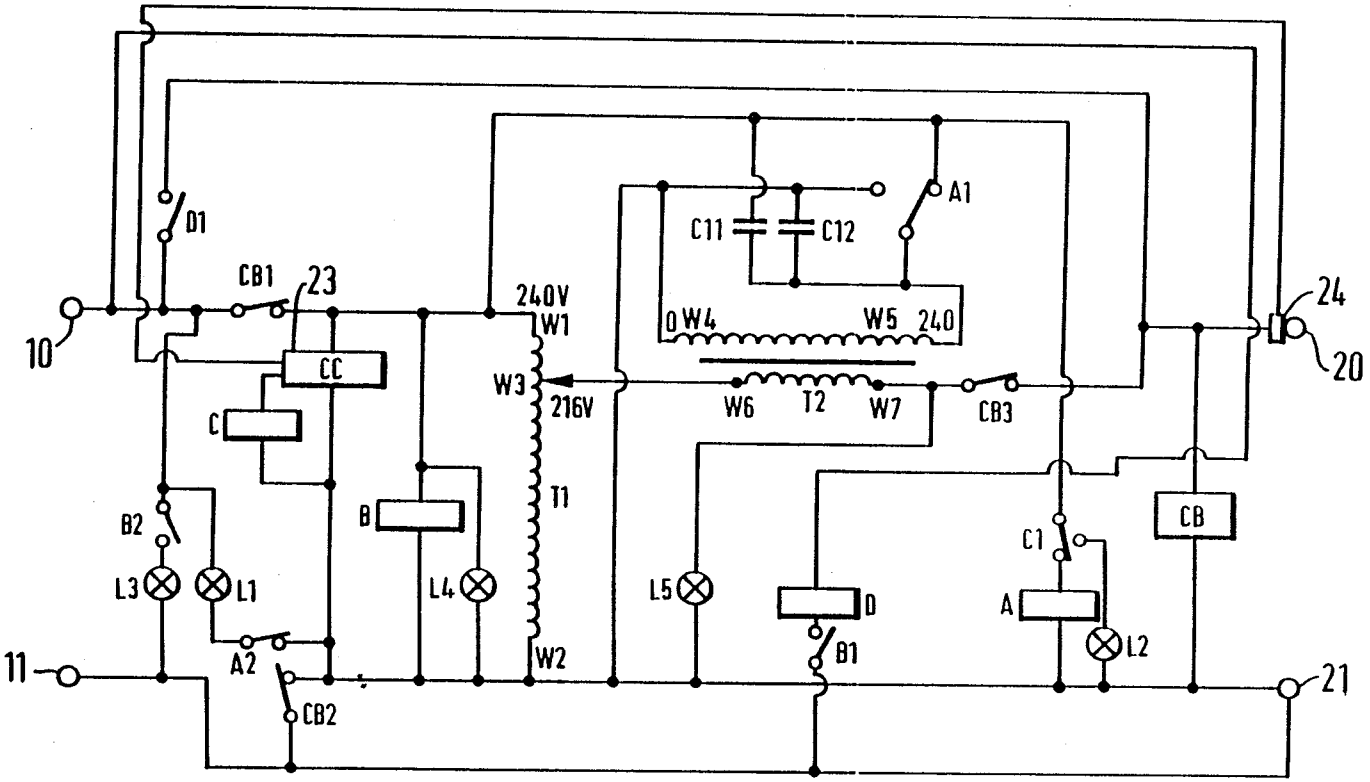
FIG. 3 is a circuit diagram of a second example of a control system of the invention according to the embodiment of FIG. 1.
Figure 4:
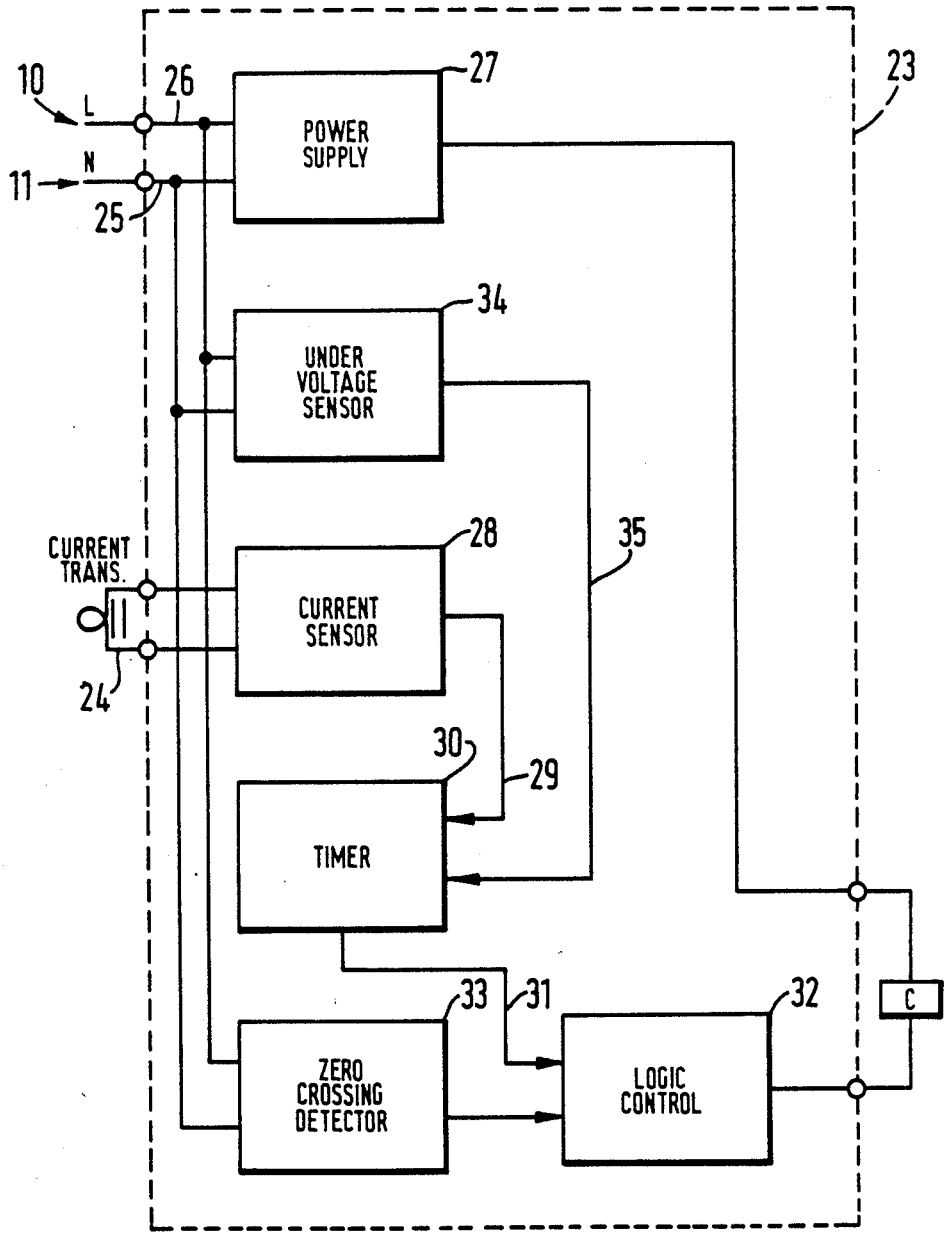
FIG. 4 is a block diagram of a control circuit CC shown in FIG. 3.
Figures 5A, 5B, 5C, 5D:
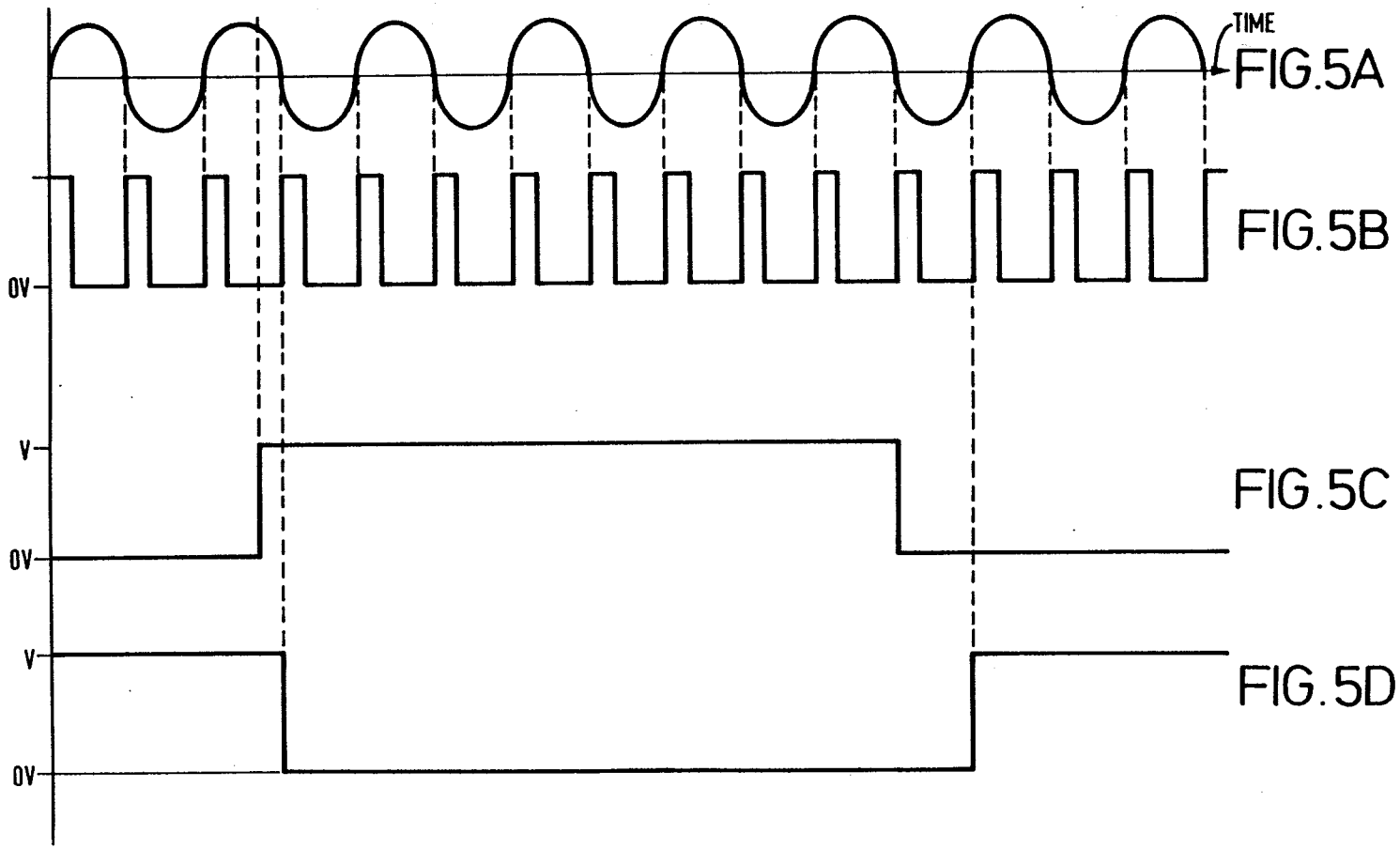
FIG. 5*a, b, c* and *d* are illustrates wave forms developed in the detector circuit of FIG. 4.

Referring now to FIG. 3, another example of the arrangement of FIG. 1 is described in more detail. In the circuit of FIG. 3, the control circuit CC comprises a circuit arrangement 23 which utilizes a current sensor 24 that senses pulses in current supplied through the output terminal 20. It has been appreciated that when the lamps are switched on, there is an initial current surge. The detector 24 comprises a transformer coil formed around the lead to terminal 20, which has induced therein a current pulse in response to the current surge produced by switch-on of the lamps. The induced current pulse is used to trigger circuit 23 so as to cause operation of a low voltage relay, C which actuates C1 and hence A1 in the manner previously described, in order to provide to output terminal 20 a voltage approximating the mains voltage, which comprises the reduced voltage from transformer T1 together with the supplemental voltage from transformer T2. After a predetermined period defined by a timer in circuit 23, the supplementary voltage from transformer T2 is switched off. The details of the control circuit 23 will now be described in more detail with reference to FIG. 4. Mains input from terminals 10, 11 is applied to lines 25, 26, the waveform being shown in FIG. 5A, and hence to an integrated power supply circuit 27 which produces a 24 volts supply for the coil of relay C. The current sensing transformer 24 is connected to an integrated current sensing circuit 28 which is adapted to produce an output pulse on line 29 when the current transformer 24 detects that the current supplied through output terminal 20 (FIG. 3) rises by more than a predetermined amount, over a predetermined current range. For example, the circuit 28 may be arranged to detect rapid current rises in excess of 2.5 amps over a range of 0 to 80 amps. The circuit does not respond to a fall in current so as to avoid spurious triggering. An output pulse on line 29 triggers an integrated circuit programmable timer 30 which produces on line 31 a logical "1" output for the duration of its timing period, shown in FIG. 5C. This period controls the duration for which the supplementary voltage from transformer T2 is supplied. A control logic circuit 32 is provided with a time base signal derived by a zero crossing detector circuit 33 which produces a pulse for each zero crossing of the ac mains supply, as shown in FIG. 5B. The logic circuit 32 thus switches current through the coil of relay C for a period shown in FIG. 5D and defined by a predetermined number of half cycles of the ac wave form (as detected by detector 33) during which the timer 30 provides its logical "1" output.

Referring again to FIG. 3, when coil C is energized, contact C1 causes contactor A to be energized so that contact A1 assumes the position shown in FIG. 3 thereby producing an output voltage at terminals 20, 21 comprising both the reduced voltage from T1 and the supplementary voltage from T2. At the end of the time period, coil C is de-energized and the supplementary voltage from transformer T2 is disconnected. In practice, the, mains supply voltage may vary substantially and reductions of 10% or more may occur during periods of peak demand. This reduction may itself reduce the value of the voltage produced by transformer T1 to a level at which a noticeable reduction in light emission from the lamps may occur or, in the case of fluorescent lamps, may result in them becoming extinguished. This problem is overcome by the arrangement shown in FIG. 4. An under-voltage sensing circuit 34 is connected to the supply rails 25, 26 to detect when the mains supply voltage falls below a predetermined level When such a fall is detected, an output is provided on line 35 to the timer circuit 30 so as to cause it to produce a logical "1" output on line 31. The timer 30 will continue to produce this output until the input on line 35 is removed As a result, the relay C is operated in response to the fall in voltage and consequently when such a low voltage condition occurs, the output at terminal 20 (FIG. 3) is boosted with the supplementary voltage from transformer T2 for the duration of the abnormally low supply voltage condition.

It will be appreciated that the arrangement described with reference to FIGS. 3 to 5 has the advantage that the supplementary voltage from transformer T2 is supplied automatically according to demand upon switch on of the lamps, with the advantage that it is not necessary to switch the lamps at the control circuit itself, as in the arrangement of FIG. 2. Thus, the circuit of FIG. 3 can be used with advantage for large banks of lamps as utilized in offices, shops and other industrial situations.

While the previously described embodiments concern single phase ac supplies, it will readily be appreciated that the invention can also be applied to multiphase (e.g., three phase supplies). A supplementary voltage may be applied through a respective transformer to each of the phases of a multiphase supply under the control of a respective circuit such as circuit 23. Alternatively, a single control circuit may be used to control injection of the supplementary voltage into all of the phases.

While in the circuit of FIG. 3, a single current sensor 24 is provided, where the environment is noisy for example, it may be of benefit to have more than one such current transformer (e.g., one at the input and one at the output of the system) and to include an arrangement to determine whether the surge is coming from up stream or downstream. If upstream this can be taken as coming from the lights. If downstream it can be taken as spurious and ignored to avoid unwanted switching into the full voltage load.

Figure 6:
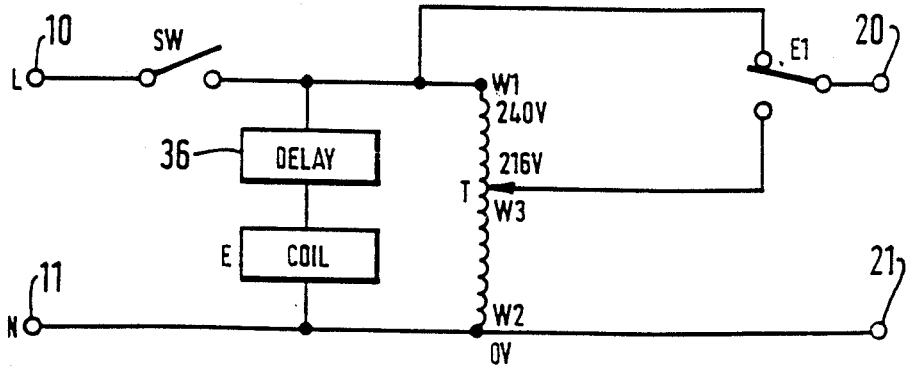
FIG. 6 is a block diagram of another embodiment of a control system according to the invention.

The invention also has application in controlling lamps individually. Referring now to FIG. 6, this illustrates a control system for use with a single lamp e.g., (a street lamp). As previously, a 240 volt mains supply voltage is applied to terminals 10, 11 and output terminals 20, 21 supply power to a single lamp. An on-off switch SW, which may be under the control of a timer or photocell (not shown) switches the main supply to an auto-transformer T to having the ends of its winding W1, W2 connected to the terminals 10, 11. The transformer T also has an intermediate tapping W3 which in use produces a voltage of e.g. 216 volts. The switched ac supply is also fed to a delay circuit 36 of any convenient design and thence to the coil of a relay E having a changeover contact E1. When the coil E is unenergized, contact E1 assumes the position shown in FIG. 6 but when the coil is energized, the contact E1 is moved into electrical connection with intermediate tapping W3.

Thus when switch SW is closed, the terminals 20, 21 initially receive a voltage comprising the transformer voltage developed between W2 and W3 and also a supplemental voltage comprising the voltage developed between W3 and W1. This closely approximates to the mains voltage of 240 volts. After a predetermined time e.g. 15 seconds, delay circuit 36 times out and consequently coil E is energized so that contact E1 is pulled into connection with tapping W3 with the result that the terminal 20 receives only the reduced voltage of 216 volts developed between the tappings W2, W3, i.e., the supplementary voltage developed between W1 and W3 is removed.

This arrangement has the advantage in comparison with the previously discussed prior proposals that the transformer T remains continuously energized and only a part of its windings are connected and disconnected for start up of the lamps. In the prior proposals, a transformer was, in its entirety, connected and disconnected through the mains. It will therefore be appreciated that the arrangement of FIG. 6 has the advantage that the required current handling capacity of contacts E1 is reduced substantially in comparison with the prior proposals.

We claim:

1. A control system for lighting rated to operate at a normal mains supply voltage comprising:

first transformer means for providing a reduced voltage below normal mains voltage for the lighting to provide reduced power during operation thereof;

second transformer means for providing a supplementary voltage when initially operating the lighting to increment the reduced voltage to a value approximating said normal mains voltage; and means for thereafter removing the supplementary voltage;

said second transformer means including means defining primary and secondary windings, the primary and secondary windings being arranged so as to induce said supplementary voltage in the secondary winding when said primary winding is energized, and the control system being so arranged that the secondary winding present negligible impedance to current flow from the first transformer means to the lighting when not producing said supplementary voltage.

2. A system according to claim 1 including means for energizing said primary winding with a mains voltage to produce said supplementary voltage, and means for producing a short circuit between ends of said primary winding upon removal of said supplementary voltages wherein the second winding presents eligible impedance to current flow from the first transformer.

3. A system as claimed in claim 1 wherein the means for removing the supplementary voltage includes timer means for removing this voltage after a predetermined period.

4. A system as claimed in claim 3, wherein the removing means includes a relay operable by the timer means.

5. A system as claimed in claim 4, wherein the removing means includes a contactor operable by the relay.

6. A system as claimed in claim 1 wherein cut-out means are provided to disconnect the control system from the lighting so as to prevent overload and possible damage to the system when a rated load is exceeded.

7. A system as claimed in claim 6, wherein the cut-out means includes a switching arrangement to by-pass the control system and maintain a mains supply to the lighting.

8. A system as claimed in claim 1 wherein indicator means are provided to show operational status.

9. A system as claimed in claim 1 including sensor means for detecting initial operation of the lighting to effect the provision of the supplementary voltage.

10. A system as claimed in claim 9 wherein said sensor means includes at least one sensor for detecting a current surge associated with initial operation of the lighting.

11. A system as claimed in claim 9 including a control circuit responsive to the sensor means and arranged to provided an output signal only in response to an increase in current said surge.

12. A system as claimed in claim 1 including sensor means responsive to the applied mains voltage for providing said supplementary voltage when said mains voltage drops below a predetermined level.

13. A system as claimed in claim 9 wherein the sensor means includes first and second sensors.

* * * * *